US008656654B2

(12) United States Patent
Kastner et al.

(10) Patent No.: US 8,656,654 B2
(45) Date of Patent: Feb. 25, 2014

(54) UPPER PART FOR A SHAFT

(75) Inventors: Friedrich Kastner, Grieskirchen (AT); Manfred Klausberger, Krems (AT); Erich Mitteregger, Micheldorf (AT)

(73) Assignee: IFW Manfred Otte GmbH, Micheldorf (AT)

( * ) Notice: Subject to any disclaimer, the term of this patent is extended or adjusted under 35 U.S.C. 154(b) by 0 days.

(21) Appl. No.: 12/597,283

(22) PCT Filed: Jun. 2, 2008

(86) PCT No.: PCT/EP2008/004357
§ 371 (c)(1), (2), (4) Date: Nov. 17, 2010

(87) PCT Pub. No.: WO2008/148507
PCT Pub. Date: Dec. 11, 2008

(65) Prior Publication Data

US 2011/0072731 A1 Mar. 31, 2011

(30) Foreign Application Priority Data

Jun. 4, 2007 (EP) ..... 07010936

(51) Int. Cl.
*E02D 27/00* (2006.01)

(52) U.S. Cl.
USPC ..... 52/169.6; 52/19

(58) Field of Classification Search
USPC ..... 52/19, 20, 169.6; 404/26
See application file for complete search history.

(56) References Cited

U.S. PATENT DOCUMENTS

| | | | | | |
|---|---|---|---|---|---|
| 302,463 | A | * | 7/1884 | Alexander | 454/340 |
| 1,793,038 | A | * | 2/1931 | Zimmermann | 404/26 |
| 3,533,199 | A | * | 10/1970 | Pickett | 52/20 |
| 4,089,139 | A | * | 5/1978 | Moffa et al. | 52/20 |
| 4,488,392 | A | * | 12/1984 | Pearcey et al. | 52/741.11 |
| 5,117,593 | A | * | 6/1992 | Tiernan | 52/20 |
| 5,852,901 | A | | 12/1998 | Meyers | |
| 6,385,919 | B1 | * | 5/2002 | McCarthy | 52/169.6 |
| 6,434,896 | B1 | * | 8/2002 | Mitchell | 52/169.6 |
| 6,695,541 | B1 | * | 2/2004 | Spence | 405/218 |

(Continued)

FOREIGN PATENT DOCUMENTS

| | | |
|---|---|---|
| AT | 309 349 | 8/1973 |
| DE | 94 20 219 | 2/1995 |
| EP | 0 906 477 | 4/1999 |
| WO | 2007/000299 | 1/2007 |

OTHER PUBLICATIONS

International Search Report issued Sep. 3, 2008 in International (PCT) Application No. PCT/EP2008/004357.

*Primary Examiner* — William Gilbert
*Assistant Examiner* — Gisele Ford
(74) *Attorney, Agent, or Firm* — Wenderoth, Lind & Ponack, L.L.P.

(57) ABSTRACT

The invention relates to a top part for a shaft, having an access part and a shaft cone which is connected to an access part and, with a connecting element on that side of the shaft cone that lies opposite the access part, can be mounted onto a further shaft element, the shaft cone having a substantially convex basic shape, characterized in that, in the region of the shaft dome, stiffening structures are disposed on the inner surface of this shaft dome, which extend substantially radially or parallelly, angularly or concentrically from one or more imaginary points or lines within or outside the dome downwards over the curved shape of the shaft cone.

4 Claims, 1 Drawing Sheet

(56) References Cited

Figure 1:
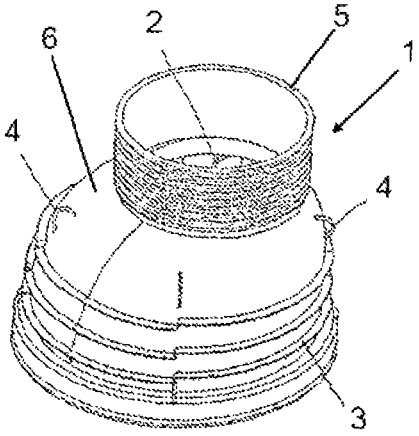

U.S. PATENT DOCUMENTS 6,915,612 B2 * 7/2005 Oakley ..... 52/107
6,997,639 B2 * 2/2006 Nadasde ..... 404/26
7,540,683 B2 * 6/2009 Salas ..... 404/25
7,627,992 B1 * 12/2009 Gavin ..... 52/20
7,926,510 B1 * 4/2011 Terry et al. ..... 137/363
2003/0145527 A1 * 8/2003 Meyers ..... 52/20

* cited by examiner

UPPER PART FOR A SHAFT

The invention relates to a top part for a shaft.

Shaft top parts are known from the prior art and usually have a convex shape. Because of this shape, the shaft top parts exhibit good resistance to compressive forces which are exerted from the subsoil surrounding the shaft.

In the region of the transition between shaft cone and shaft access part, deformations are repeatedly formed. In this region, radially inwardly directed force components can cause the shaft top part to bend inwards at this location or to be dented beyond the range of tolerance.

EP 0 906 477 B1 discloses a top part for a shaft having an access part and a shaft cone which is connected to the access part and, with a peripheral edge on that side of the shaft cone that lies opposite the access part, can be mounted onto a shaft ring, the shaft cone having a substantially convex basic shape, wherein in the region of the transition from the access part to the shaft cone a reinforcing rib, aligned substantially parallel to the plane in which the peripheral edge is situated, is provided on the outer casing of the shaft cone and extends over the whole of the periphery.

WO 2007/000299 A1 discloses a shaft top part for a shaft, having an access part and a shaft cone which is connected to an access part and, with a connecting element on that side of the shaft cone that lies opposite the access part, can be mounted onto a further shaft element, the shaft cone having a substantially convex basic shape, wherein the shaft cone has at least 3 portions, in which there are disposed stiffening elements arranged substantially parallel to one another.

These shaft systems must either be produced using only complex tools or, by dint of the large wall thicknesses, are very heavy and do not, moreover, have optimal load-bearing capacity.

The object of the invention was to provide a shaft top part having smallest possible wall thickness yet high stability, which can be easily produced with simple tools.

The subject of the invention is therefore a top part for a shaft, having an access part (i.e., an access opening) and a shaft cone which is connected to the access part and, with a connecting element on that side of the shaft cone that lies opposite the access part, can be mounted onto a further shaft element, the shaft cone having a substantially convex basic shape, characterized in that, in the region of the shaft dome, stiffening structures are disposed on the inner surface of this shaft dome, which extend substantially radially or parallelly, angularly or concentrically from one or more imaginary points or lines within or outside the dome downwards over the curved shape of the shaft cone.

The shaft top part according to the invention, given the same wall thickness as the prior art, has higher load-bearing capacity. If the wall thickness is significantly reduced, equal load-bearing capacity is achieved.

In addition, a connecting element is provided, by means of which the shaft top part according to the invention can be sealingly mounted onto other shaft parts.

The stiffening structures of the shaft top part according to the invention allow the incurred loads (for example traffic load, compressive load) to be reliably reduced.

Viewed in cross section, the internal stiffening structures can be configured as a rib, bulge, bead, trapezoidally, rhombically, or as an I-beam, semi-circularly, elliptically, square, triangularly, or as a polygonal structure optimized according to the application, so that the rigidity of the curved basic shape of the shaft cone is optimized.

The distances between the stiffening structures and the dimensions of the stiffening structures are likewise optimized and realized according to geometry and load-bearing requirement.

The internal stiffening structures are protected from damage by the filling material (earth, ballast, gravel and the like) or by manipulations (for example during installation).

A constant stability of the shaft top part is therefore ensured.

The substantially smooth outer side additionally enables a more homogeneous compacting of the filling material than with known shaft top parts.

As a result of the arrangement of the stiffening structures in the inner region, an efficient tool production is possible. As a result of the substantially smooth outer side, the outer shells of the tools or moulds can therefore also be shaped substantially more simply.

In one embodiment, the shaft top part can have further internal stiffening structures, which extend over the inner periphery.

Viewed in cross section, these elements can be configured as a rib, bulge, bead, trapezoidally, rhombically, or as an I-beam, semi-circularly, elliptically, square, triangularly, or as a polygonal structure optimized according to the application. They can be arranged concentrically, eccentrically radially, or angularly about an imaginary point within or outside the dome.

In one particular embodiment, the top part for the shaft can have on its outer side lift prevention elements extending, if need be, over the periphery, which can be realized in the form of ribs, webs, segments, lugs, knobs, spikes and the like. These lift prevention elements can here, according to shape, be continuous or non-continuous in their arrangement, for example can also be realized in the form of concentric circles (from an imaginary centre point which can be the same as or different from the imaginary point from which the stiffening structures extend).

The shape of the lift prevention elements can here be optimized according to the filling material used.

In a further embodiment, other functional structures, such as lifting aids and the like, can be freely positioned on the outer side.

The access part can be eccentrically or centrically arranged, holding elements being able to be provided, if need be, on the inside.

In one particular embodiment, on the ring of the shaft top part an apparatus can be provided, which allows the top part to be centred on a shaft middle part or bottom part. This apparatus can be configured as a visual marking or as a mechanical guide aid (for example as a guide bolt or fork or similar).

The shaft top part according to the invention is preferably made from thermoplastically workable plastics, preferably in an injection moulding process.

The shaft top part according to the invention is suitable, for example, for sewage shafts, water pump shafts, safety shafts, one-man bunkers, water stores, pellet tanks, buffer stores for geothermal heat, service shafts (for example for electric cables).

Figure 2:
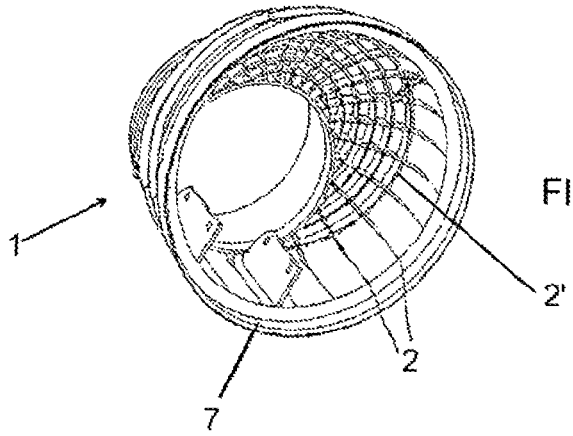
Figure 3:
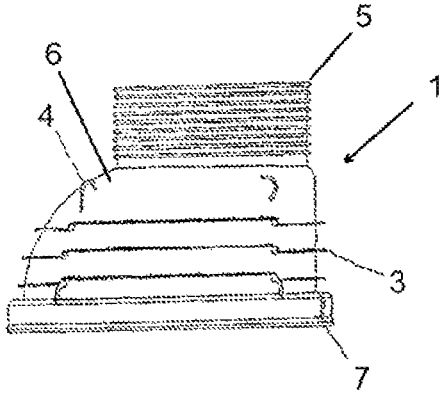

The shaft top part according to the invention is represented in FIGS. 1 to 3.

In these, 1 denotes the shaft top part having the access part 5, the shaft cone 6 and the connecting element 7. Further, 2 denotes the stiffening structures (i.e., first stiffening structures) extending downward over the curved shape of the shaft cone 6, and 2' refers to the further internal stiffening structures (i.e., second stiffening structures) which can extend over the inner periphery of the shaft cone 6. In addition, 3 refers to the lift prevention elements, and 4 denotes holding elements.

The invention claimed is:

1. A shaft arrangement, comprising:

a shaft top part, wherein the shaft top part includes a shaft cone having an access opening at one end of the shaft cone, and having a connecting element on an opposite end of the shaft cone, the shaft cone having a substantially convex dome shape, first stiffening structures disposed on an inner surface of the dome-shaped shaft cone so as to extend substantially radially or parallelly, angularly or concentrically from one or more imaginary points or lines within or outside the shaft cone, the first stiffening structures extending downwards along a curved shape of the shaft cone, and lift prevention elements provided on a radially outer surface of the shaft cone, wherein the lift prevention elements are comprised of ribs, webs, lugs, knobs and/or spikes; and a shaft element, the shaft top part being connected to the shaft element via the connecting element of the shaft cone, wherein the shaft element is a sewage shaft or a water pump shaft; and wherein the shaft top part is made from thermoplastically workable plastics by means of an injection moulding process.

2. The shaft arrangement according to claim 1, wherein each first stiffening structure is formed as a rib, bulge, bead, trapezoidally, rhombically, or as an I-beam.

3. The shaft arrangement according to claim 1, further comprising:

holding elements provided on an outer surface of the shaft cone.

4. The shaft arrangement according to claim 1, further comprising:

second stiffening structures which extend over an inner periphery of the shaft cone, and which are arranged concentrically, eccentrically radially, or angularly about an imaginary point which is within or outside the shaft cone.

* * * * *